United States Patent [19]

Chambers

[11] 3,967,832

[45] July 6, 1976

[54] COMPOSITE SKATE ASSEMBLY

[75] Inventor: Alan F. Chambers, Agincourt, Canada

[73] Assignee: Nylite Skate Company of Canada Ltd., Markham, Canada

[22] Filed: Oct. 6, 1975

[21] Appl. No.: 619,751

[52] U.S. Cl. ..... 280/11.12; 264/273

[51] Int. Cl.[2] ..... A63C 1/02

[58] Field of Search ..... 280/11.12, 11.17, 11.18, 280/11.3; 264/273, DIG.71

[56] References Cited

UNITED STATES PATENTS

| | | | |
|---|---|---|---|
| 1,100,976 | 6/1914 | Hille | 280/11.18 |
| 1,405,981 | 2/1922 | Drevitson | 280/11.12 |
| 1,666,690 | 4/1928 | Drevitson | 280/11.12 |
| 3,212,786 | 10/1965 | Florjancic et al. | 280/11.12 |
| 3,558,149 | 1/1971 | Weidenbacker | 280/11.12 |

FOREIGN PATENTS OR APPLICATIONS

| | | | |
|---|---|---|---|
| 585,720 | 10/1959 | Canada | 280/11.12 |

*Primary Examiner*—M. H. Wood, Jr.
*Assistant Examiner*—David M. Mitchell
*Attorney, Agent, or Firm*—Reising, Ethington, Barnard, Perry & Brooks

[57] ABSTRACT

An ice skate assembly comprising a hardened steel blade, a thermoplastic blade-supporting body molded about the upper portion of said blade and means associated with the blade to permit the plastic to shrink relative to the blade after molding in such a way as to prevent the creation of localized stresses in the plastic.

7 Claims, 7 Drawing Figures

COMPOSITE SKATE ASSEMBLY

BACKGROUND OF THE INVENTION

Traditionally ice skates are built so as to comprise a hardened steel blade suitably secured to a metal body or frame which includes elevated toe and heel platforms secured to the underside of a boot. In the best quality skates made today, the blades and body or frame are made of steel with the blade being secured to a tubular section of the frame through spot welding.

Several difficulties exist with skates utilizing a metal blade-supporting body or frame. First, in fabricating a metal blade-supporting body to a blade, it is conventional practice to use eight different steel components which are variously spot welded together. Not only is there a problem in insuring the integrity of such welds, but in welding the blade to the body there is the constant danger of weakening or reducing the temper of the hardened steel blade. As will be seen in the present invention, there are two major components, a monolithic plastic body and a hardened steel blade, which are readily connected by fastening means which in no way affect the critical temper of the hardened blade. Thus fewer major components, less expensive materials and fewer assembly operations are required with the present invention.

Next, it has become increasingly difficult to obtain consistently high quality steel for use in such blade-supporting bodies. As lesser quality steel has been used, breakage and rusting of such bodies has become more frequent.

It is also known that if the blade-supporting body can be suitably made of a plastic material, an important saving in weight can be realized, thereby importantly reducing energy expenditure and thereby lessening skater fatigue. Each skate made in accordance with the present invention is on the order of 4 ounces lighter than its all-steel counterpart. It is estimated that an aggressive hockey forward takes over 4000 strides and thus likely skates several miles during a game. At the same time, an Olympic track study determined that the addition of 1 ounce to each foot of a conditioned athlete increased his energy consumption by 14% during a 4-mile run. Thus, it is apparent that the saving of even a few ounces in overall skate weight represents a significant energy saving factor to a skater.

A further advantage of the present invention is that through the use of an extremely tough plastic, such as a polycarbonate, the blade-supporting body is not susceptible to denting, warping, chipping or rusting, all of which are common with a steel body.

The present invention relates to a new type of composite skate construction wherein the blade-supporting body or frame is made of a suitable thermoplastic material with a hardened steel blade uniquely fastened thereto and is a companion application to Ser. No. 608,499 filed Aug. 28, 1975. As indicated in U.S. Pat. No. 3,212,786 Florjancic et al., Canadian Pat. No. 585,780 Kirkpatrick et al. and Russian Pat. No. 123,068 Abelson, many efforts have been made to produce an ice skate employing a plastic blade-supporting body. Not withstanding the great potential advantages thereof, no one has heretofore successfully produced such a composite skate of commercial quality and particularly one that could withstand the extremely rigorous loads and abuse to which hockey skates are subjected.

Knowing of the superior performance qualities of a skate utilizing a plastic blade-supporting body, applicant sought a way to produce such a commercially feasible composite type skate. Applicant's original efforts resulted in a composite type skate having greatly improved performance characteristics. More specifically, the skates were lighter and far more responsive to the skater's demands. However, as with skates made according to prior art teachings, a serious problem developed with respect to fracturing or cracking of the plastic body. Such cracking either began immediately after manufacture or developed within a reasonably short time of use. After considerable experimentation, applicant discovered that while commercially available thermoplastic materials, such as those of the polycarbonate group, had more than enough inherent structural strength, the manner in which the hardened steel blade was joined to the plastic body was critically important. Applicant found in his earlier designs, like those of the prior patented art, that when the plastic body is initially molded and mechanically interlocked with the skate blade, severe localized stresses are set up in the plastic. It was further found that from these highly stressed areas cracks emanated which eventually caused the body to fail or sufficiently disrupted its appearance as to cause the user to lose confidence in its safety.

Thus, the present invention is directed to a composite skate design utilizing a thermoplastic blade-supporting body joined to the skate blade in such a way as to eliminate such critical stress areas within the plastic body thereby preventing cracking or fracturing of the body.

Hockey players who have tested skates made in accordance with the subject invention under playing conditions claim they sense more "life" or responsiveness in the blades. It is assumed that this reaction may be attributable to the greater flexibility of the plastic body/steel blade assembly combined with its lighter weight as compared to its all-steel counterpart.

SUMMARY OF THE INVENTION

More specifically, the invention relates to such a composite type skate whereby the plastic blade-supporting body may be directly molded upon or otherwise connected to the skate blade in a manner to eliminate critical molding stresses within the body. Applicant discovered in molding a plastic body about a skate blade such that the plastic material flows through openings in the blade so as to tightly interlock the plastic and the steel blade, critical stresses are introduced into the plastic due to differential rates of shrinkage between the plastic and the steel blade. For example, it was found in molding the plastic body to the blade, temperatures of approximately 500°F were utilized and when the plastic body and steel blade were allowed to cool that the steel blade had a shrink factor of 0.004 while the plastic had a shrink factor of approximately 0.060. Thus, the plastic material flowing through various holes or openings in the steel blade and keying or fusing back to itself set up shrinkage-induced molding stresses due to interference by the blade during cooling. It was such molding stresses in the plastic that developed cracks resulting in eventual failure of the blade-supporting body.

In the present invention a unique composite skate design is achieved wherein a thermoplastic blade-supporting body is molded to and mechanically interlocked with a steel blade in a way as to eliminate critical stress concentrations of a type and magnitude likely to cause cracking or fracturing of the plastic body. More specifically, in the present invention the thermoplastic body can be molded directly about the skate blade in a manner which permits relatively free shrinkage movement of the plastic relative to the steel blade without critical interference by the blade.

In companion application Ser. No. 608,499 filed Aug. 28, 1975, holes formed in the skate blade are temporarily plugged to prevent the thermoplastic body material from flowing therethrough during the molding operation. Subsequent to molding and cooling, the blade holes are unplugged and suitable fastening means interlock the blade to the body.

In the present invention a unique interlocking arrangement is provided which eliminates the necessity of temporarily plugging the blade holes and the subsequent insertion of independent fastening means for interlocking the blade to the body. At the same time, means are disposed in the blade holes which permit the body plastic to flow through the blade holes during the molding operation in such a way as to accommodate relative shrinkage between the plastic and blade to thereby avoid setting up critical stresses in the plastic body.

More specifically, in the present invention the blade is formed with a normal lower or skating surface having upwardly curved front and rear portions. An upper edge or surface of the blade is substantially flat, i.e. non-curving, and continuous throughout its length. A plurality of longitudinally aligned holes are formed transversely of the blade subadjacent the upper blade surface. Hollow eyelets or rivets are next disposed within the blade holes so as to be radially adjustable relative thereto. In the preferred form, the external diameter of each eyelet is sufficiently smaller to permit the eyelet to be radially shiftable relative to the blade hole. Each end of the eyelet includes a flange which covers the space between the outside diameter of the eyelet and the blade hole. Thus, with the eyelets mounted within the blade holes, the thermoplastic material is molded about the upper portion of the blade and flows through the hollow eyelet while being prevented by the eyelet flanges from entering the space between the outside diameter of the eyelet and the blade hole. As the plastic body and blade cool after molding, shrinkage induced pressures will enable the plastic to shift the eyelets thereby preventing the build-up of critical stresses in the plastic body.

The details of the invention will be apparent by further reference to the following description and illustrating drawings.

Figure 1:
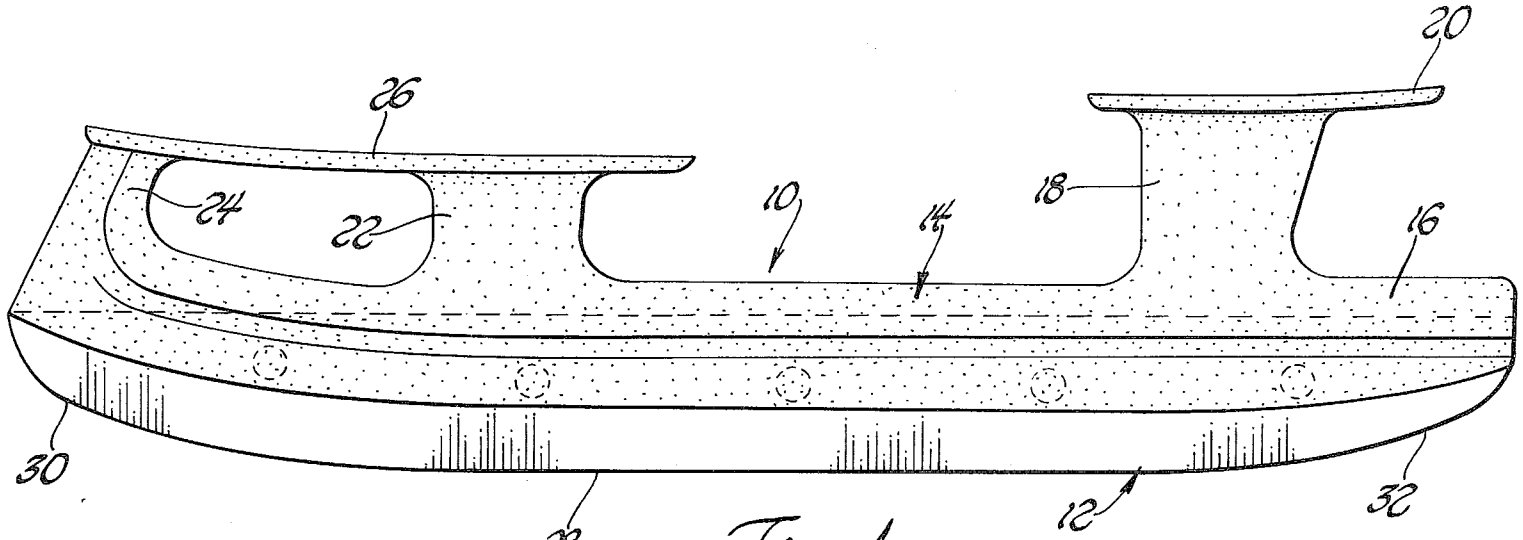
FIG. 1 is a side elevation of the skate body/blade assembly.
Figure 2:
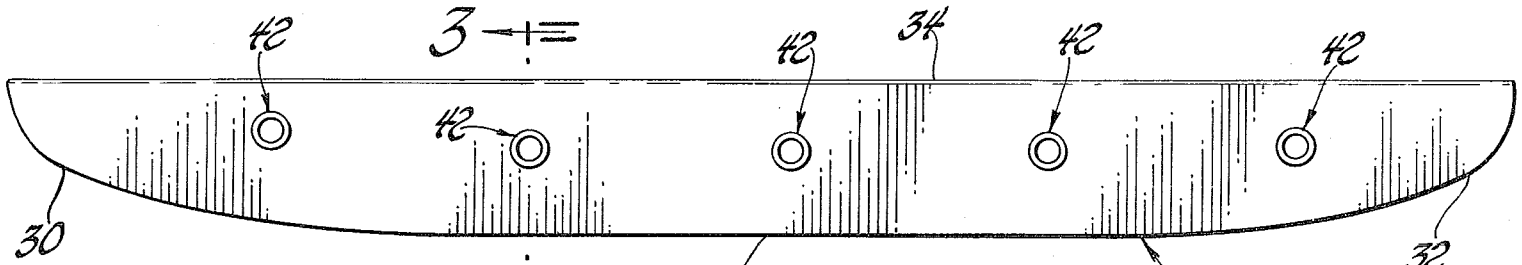
FIG. 2 is a side elevation of the blade before the body is molded thereto.

Referring to FIGS. 1 and 2, a composite skate assembly is indicated generally at 10 and includes a steel blade 12 suitably secured to a monolithic plastic body 14. Body 14 includes a longitudinally extending blade-supporting section 16, a first hollow pedestal 18 having a heel plate 20 formed at the upper end thereof, and second hollow pedestal 22 and a forward strut 24 having a toe plate 26 integrally joined with pedestal 22 and strut 24.

Blade 12 is blanked or otherwise formed to the configuration of FIG. 2 from a 1040-1075 carbon steel of approximately 0.125 inch thickness. In this final shape, blade 12 includes a lower edge or surface having a generally centrally disposed, ice-engaging portion 28 and upwardly inclined front and rear portions 30 and 32. Blade 12 also includes an upper surface 34. In traditional skate design, upper blade surface 34 would normally include upwardly inclined end portions paralleling portions 30 and 32 of the lower blade edge. However, in the present invention it is preferred that upper blade surface 34 be flat and continuous throughout its length to facilitate post-molding shrinkage of body 14 relative to blade 12.

It has been found that molding a plastic about a sharp metallic edge is likely to create a stress and thus an incipient cracking or fracturing area in the plastic where it contacts such edge particularly when subjected to high loading. Accordingly, it is preferred to slightly radius or transversely round the high-load outer edges 36 and 38 of upper blade surface 34 as seen in FIG. 3.

Figure 3:
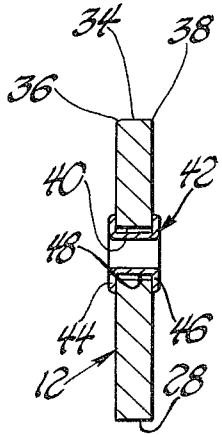
FIG. 3 is a cross-section along line 3—3 of FIG. 2.

As best seen in FIGS. 2 and 3, a plurality of longitudinally aligned holes 40 are formed transversely of blade 12 subadjacent upper surface 34.

After forming blade 12, including providing holes 40 and radiusing edges 36 and 38, the blade is heat treated to a Rockwell Scale hardness of about 58C.

As already indicated, previous attempts to form a plastic body about a blade involved molding the plastic so that it would flow through blade holes or other discontinuities and thereby interlock with the blade during the molding operation. Since upon cooling the thermoplastic body shrinks to a far greater degree than does the steel blade (generally in the ratio of 0.060 to 0.004), severe stresses were set up in those areas where the plastic is so interlocked with the steel blade.

The basic principle in my companion application Ser. No. 608,499 filed Aug. 28, 1975 is to avoid creating molding stresses of a magnitude which will cause cracking or fracturing by plugging the blade holes during the molding operation whereby the plastic body may shrink relative to the blade prior to finally interlocking the body and blade together through suitable rivet or connecting means.

In the present invention, radially shiftable or adjustable means are disposed within each of the blade holes 40 prior to the molding operation in such a way that while the plastic may extend transversely through the blade holes during the molding operation, the plastic may still shrink, i.e. radially adjust with respect to the blade holes, in a manner to prevent the creation of fracturing stresses.

Figure 4:
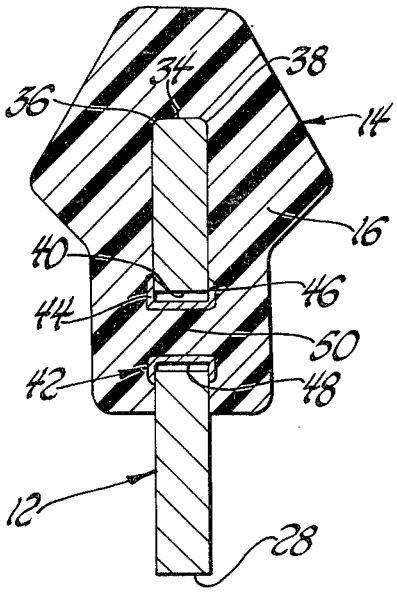
FIG. 4 is a cross-sectional view through the monolithic plastic skate body and blade immediately after molding.
Figure 5:
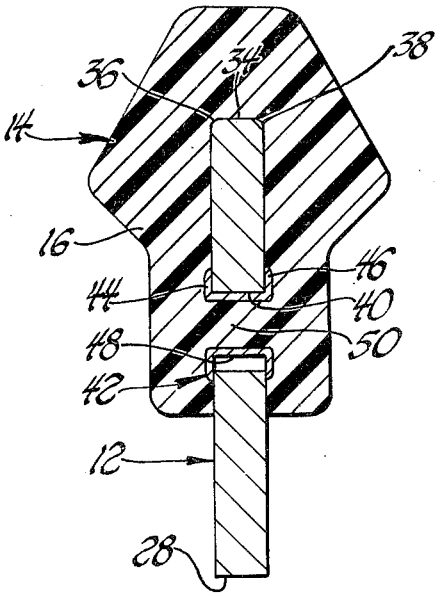
FIG. 5 is a cross-sectional view through the monolithic plastic skate body and blade after the body and blade have cooled.

As best seen in FIGS. 2 through 5, hollow eyelets or rivets 42 are disposed within blade holes 40. Referring specifically to FIGS. 3 through 5, it will be noted that eyelets 42 include axially spaced flanges 44 and 46 with an intermediate tubular portion having an outside diameter 48 smaller than the diameter of blade holes 40. Flanges 44 and 46 are of a sufficient diameter that in all radial positions the space between the outside diameter 48 and blade holes 40 is always covered by the flanges. In practice, it is found that the outside diameter 48 of eyelet 42 should be about 0.010 inch smaller than the diameter of blade hole 40.

It is apparent that hollow eyelets or rivets 42 can be radially adjusted relative to blade holes 40. Accordingly, during the operation whereby blade-supporting body 14 is molded about skate blade 12, molten plastic will flow through the hollow rivets 42 to provide integral or monolithic portions 50 which interlock blade 12 to body portion 16. At the same time, rivet flanges 44 and 46 prevent the molten plastic from flowing between the outside diameter 48 of the rivets and the blade hole 40. The position of the rivets 42 in blade holes 40 immediately upon molding is depicted in FIG. 4. As the plastic and blade cool after molding, the plastic will shrink relative to the blade and unless free to move relative to the blade to some limited degree, severe stresses will be set up in the plastic resulting in an incipient cracking or fracturing condition.

In the present invention, the radial adjustability of the eyelets or rivets 42 permits the plastic to shrink and adjust relative to holes 40 thereby avoiding the creation of critical stresses in the plastic around the blade hole areas. The radial adjustment is depicted in FIG. 5. FIG. 5 is not meant to indicate that the direction of shrinkage of the plastic would be such as to cause the plastic to move only in the direction therein indicated, but merely to indicate that such radial adjustment does, in fact, occur. As a matter of fact, it has been observed that shrinkage of the plastic body relative to the blade is both upward and from the ends of the skate inward toward the center of the blade. This centerwise or longitudinal shrinkage of the plastic is particularly observable where the flat upper blade edge 34 is used thereby preventing this edge from interfering with the longitudinal component of plastic shrinkage. Once the natural resultant direction of plastic shrinkage is ascertained, it is possible to initially offset the hollow eyelets or rivets 42 in the opposite direction within blade holes 40 to maximize the ability of the eyelet and plastic extending therethrough to adjust relative to the blade.

Figure 6:
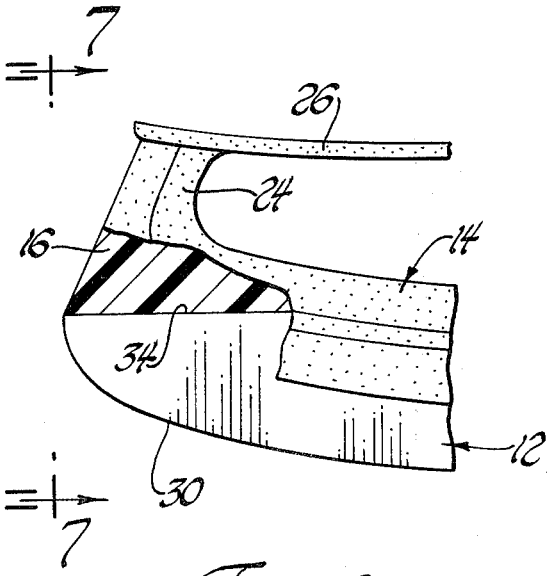
FIG. 6 is a fragmentary elevational view of the front end of the skate body/blade assembly partially broken away to show the relationship between the front end of the blade and the superadjacent portion of the plastic body.
Figure 7:
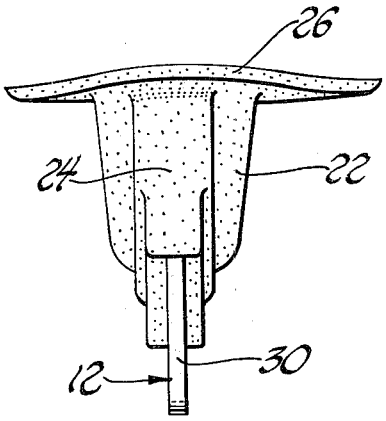
FIG. 7 is a view along line 7—7 of FIG. 6.

FIGS. 6 and 7 illustrate that plastic body portion 16 surrounds the sides of skate blade 12 but does not enclose the upwardly inclined end portion 30 of the lower blade edge thereby leaving the body free to shrink longitudinally relative to the blade, again so as to avoid the setting up of mechanical interference between the blade and the plastic body during post-molding shrinkage and thereby eliminating the creation of critical stress areas. The same non-enclosing relationship is preferred between plastic body portion 16 and the upwardly curving, rear end portion 32 of the lower blade edge 28.

It is apparent that a strong, tough and not brittle plastic material should be used to form body 14. While other thermoplastic materials may be satisfactory, plastics of the polycarbonate group and designated by their manufacturers as LEXAN (General Electric) and CYCOLOY (Borg Warner) have proved highly satisfactory in this application.

While certain embodiments of the invention have been described for purposes of illustration, it will be understood that there may be various other embodiments and modifications within the scope of the invention as set forth in the hereinafter appended claims.

What is claimed is:

1. An ice skate assembly comprising a hardened steel blade having upper and lower surfaces extending throughout the length thereof, said lower surface providing an ice-engaging portion, a plurality of longitudinally spaced holes formed transversely of said blade subadjacent said upper surface, a thermoplastic blade-supporting body molded about said blade to enclose said upper blade surface and said holes while leaving unenclosed the ice-engaging portion of said lower blade surface, said plastic body including integral elements extending through said blade holes, and means disposed intermediate said integral body elements and said blade holes and which means permit said elements to adjust relative to said blade as said plastic body shrinks after molding about said blade.

2. A skate assembly as set forth in claim 1 wherein said means comprise hollow tubular members mounted for radial displacement within said blade holes.

3. A skate assembly as set forth in claim 2 wherein each tubular member includes end portions adapted to prevent said plastic body from extending between said member and said blade holes.

4. A skate assembly as set forth in claim 1 wherein said means comprise hollow rivets, each rivet including a tubular section disposed within one of said blade holes, said tubular section having an outside diameter sufficiently smaller than the diameter of each blade hole to permit radial displacement of the rivet relative to the hole, a radially outwardly extending flange formed at each end of the tubular section and overlaying the hole to prevent the plastic body from entering the space between the outside of the tubular rivet portion and the blade hole, said integral body elements extending through the tubular sections of the hollow rivets.

5. An ice skate assembly comprising a hardened steel blade having upper and lower surfaces extending throughout the length thereof, said lower surface providing an ice-engaging portion and terminating in upwardly inclined front and rear end portions, said upper surface being substantially flat and continuous throughout the length of said blade, a plurality of longitudinally spaced holes formed transversely of said blade subadjacent said upper blade surface, a plastic blade-supporting body molded about said blade to surround the upper blade surface and said holes while leaving unsurrounded the ice-engaging portion and the upwardly inclined front and rear end portions of the lower blade surface, and a tubular means disposed in and radially adjustable relative to each of said blade holes, said plastic blade-supporting body extending through each of said tubular means to interlock said blade to said body.

6. An ice skate assembly comprising a hardened steel blade having upper and lower surfaces extending throughout the length thereof, said lower surface providing an ice-engaging portion and terminating in upwardly inclined front and rear end portions, a plurality of longitudinally spaced holes formed transversely of said blade subadjacent said upper blade surface, a plastic blade-supporting body molded under heat and pressure about said blade to surround the upper blade surface and the holes, and a tubular means disposed in and radially adjustable relative to each of said blade holes, said plastic blade-supporting body including portions internally filling each of said tubular means to interlock said blade to said body such that said body portions and tubular means may adjust radially relative to said blade holes as said molded body cools after molding.

7. The method of forming a skate assembly of the type including an elongated steel blade and a plastic blade-supporting body comprising the steps:

a. forming a blade from a prehardened steel blank so as to provide a flat and continuous upper surface and a lower ice-engaging surface terminating in upwardly curved front and rear end portions, b. forming a plurality of longitudinally spaced holes transversely of said blade and subadjacent said upper surface, c. heat treating to harden said blade, d. mounting a hollow eyelet for radial adjustment within each of said blade holes, e. molding a thermoplastic blade-supporting body about the upper portion of said blade so that said plastic body includes portions extending through each of said eyelets whereby said body portions and eyelets may radially adjust relative to said holes as said thermoplastic material shrinks upon cooling.

* * * * *